United States Patent [19]

Connor et al.

[11] Patent Number: 4,797,794

[45] Date of Patent: Jan. 10, 1989

[54] REFLECTOR LAMP

[75] Inventors: William G. Connor, Peterborough; Chris Coliandris, Hillsboro, both of N.H.

[73] Assignee: GTE Products Corporation, Danvers, Mass.

[21] Appl. No.: 84,352

[22] Filed: Aug. 12, 1987

[51] Int. Cl.[4] ..... H01R 33/00

[52] U.S. Cl. ..... 362/226; 362/296; 362/205; 362/295; 313/318; 313/331; 200/570

[58] Field of Search ..... 362/226, 296, 297, 157, 362/197, 202, 203, 204, 205, 208, 263, 295; 439/611-619; 29/842, 837, 838, 844, 845; 313/113, 318, 331; 200/155 R, 284, 60

[56] References Cited

U.S. PATENT DOCUMENTS

| | | | |
|---|---|---|---|
| 2,730,689 | 1/1956 | Lamb et al. | 439/617 |
| 3,271,533 | 9/1966 | Butler | 200/155 R |
| 3,639,750 | 2/1972 | Anthonijz | 362/226 |
| 4,287,448 | 9/1981 | Bradley | 439/617 |
| 4,385,257 | 5/1983 | Fitzgerald | 313/318 |
| 4,427,255 | 1/1984 | Cox | 362/296 |

FOREIGN PATENT DOCUMENTS

| | | | |
|---|---|---|---|
| 423778 | 4/1911 | France | 200/155 R |
| 686513 | 1/1953 | United Kingdom | 439/617 |

*Primary Examiner*—Ira S. Lazarus
*Assistant Examiner*—D. M. Cox
*Attorney, Agent, or Firm*—Lawrence R. Fraley; William E. Meyer

[57] ABSTRACT

A reflector lamp for use in a device (i.e., flashlight) that includes a reflector member having a reflecting portion and a base neck portion with an extending stub portion. A lamp capsule (i.e., low wattage tungsten halogen capsule) is disposed within the reflector member and has a pair of lead wires extending therefrom to be received at said stub portion. The stub portion includes oppositely disposed elongated slots of rectangular cross-section formed therein while the lead wires in turn each include, along at least a segment thereof, a workhardened rectangular cross-section of dimension sufficient to enable snug receipt thereof in one of the slots. The lead wires are thus capable of being disposed within the respective slots without the requirement of adhesive or glue therebetween. Further, the lead wires are disposed to a depth sufficient to maintain an interlock therebetween despite exertion of compressive forces imposed on the leads by respective contacts which open and close against the lead wires.

22 Claims, 3 Drawing Sheets

REFLECTOR LAMP

TECHNICAL FIELD

The present invention relates in general to low wattage reflector lamps such as those employing a plastic reflector and tungsten halogen capsule. These reflector lamps may be employed, by way of example, in flashlights. More particularly, the present invention relates to an improved technique for securing capsule leads in this type of reflector lamp.

BACKGROUND

Existing reflector lamps of the type that are disclosed herein are generally low wattage lamps that are typically used in applications not requiring substantial light output. For example, those low wattage reflector lamps may be used in flashlights. The reflector lamp is typically comprised of a reflector member that supports a lamp capsule such as a tungsten halogen capsule. The reflector member typically includes a concave reflecting portion and a base neck portion at which the lamp capsule is supported. There is also included an extending stub or tip which projects from the neck portion of the reflector member and is adapted to receive a pair of leads that in turn extend from the lamp capsule.

At the present time, as will be described hereinafter, lamps such as described above have typically used lamp capsules with round lead wires that are received in round, similarly configured slots in the reflector member stub. The lamp capsule is typically supported in the base neck portion by means of a retainer or the like and the leads extend therefrom and are disposed in the round configured slots in the reflector's extending stub.

With this existing, known construction, there is a requirement that the leads be bonded to the reflector member. This bonding occurs with the use of an appropriate glue, which gluing is deemed necessary to prevent the leads from being dislodged from their accommodating slot by compressive forces imposed on the leads by respective contacts (i.e., those within the flashlight and forming a part of the circuit path thereof) that open and close against the leads. Furthermore, the leads may be subject to dislodgement, not only when the device is turned on and off, but also upon insertion of the reflector into the device (i.e., flashlight) into which it is to be used, particularly when such insertion requires rotational positioning and interlocking the reflector lamp.

There are a number of disadvantages associated with the use of glue for retaining leds as defined above. Such glues may emit toxic fumes which can present a potential hazard to those assembling such devices. Furthermore, there is the added cost and time required with the additional gluing operation. In some instances, it has been found that up to ninety percent of the devices produced have required that the lead wires be scraped to remove the glue from the outer surface thereof to achieve proper contact. The gluing step may also mean, depending on the glue utilized, that the reflector lamp must set for a prolonged time (i.e., approximately 24 hours) to dry, which in turn creates a space, storage and handling problem as well as adding to the overall time required to produce the device.

Other problems associated with the use of glue include the possibility for poor electrical contact (between lead wires and associated contacts) due to the presence of glue on the lead wires. There is also a problem, because of the use of the glue, in maintaining proper dimensions between the lead wires. It is difficult to control the thickness of the glue layer that is applied. This means that the leads cannot be consistently held apart by a desired, precise dimension. This in turn can cause inconsistent lead contact in use.

DISCLOSURE OF THE INVENTION

One object of the present invention, therefore, is to provide an improved low wattage reflector lamp.

Another object of the present invention is to provide an improved relfector lamp in which, in particular, the metallic lead wires are maintained in a more secure interlocked position in the reflector lamp.

A further object of the present invention is to provide an improved reflector lamp as in accordance with the preceding objects and in which the lamp fabrication is carried out more simply and readily by eliminating the requirement of gluing to secure the lead wires into the reflector member. The elimination of the gluing step also eliminates all of the problems associated therewith as have been detailed hereinbefore.

Still another object of the present invention is to provide an improved method of fabricating of a reflector lamp in which the method steps are simplified primarily by elimination of the requirement for gluing of the lead wires to the reflector member, thereby eliminating all of the aforementioned problems associated therewith.

Still a further object of the present invention is to provide an improved reflector lamp in which the lamp capsule leads are flattened to provide a substantially rectangular shape (in cross-section) for receipt in a substantially rectangular shaped (in cross-section) slot in the reflector member stub. Significantly, the flattening of the lead wires also provides a workhardening thereof thus making the lead wires more rigid and strengthened, which in turn prevents bending and dislodgement thereof.

In accordance with one aspect of the invention, there is provided an improved low wattage reflector lamp that is comprised of a reflector member having a reflector portion and a base neck portion with a stub or tip extending therefrom. The reflector member may be substantially completely constructed of a plastic material with the appropriate reflective coating on the reflecting portion. A lamp capsule, such as a tungsten halogen capsule, is disposed in the reflector's member base neck portion and has a pair of leads extending therefrom to be received at the reflector's stub or tip. The stub has oppositely disposed elongated slots that are of a substantially rectangular cross-section. The pair of leads each also have, along at least a segment thereof, a substantially rectangular shape (in cross-section) of dimensions designed to provide for snug receipt in a respective slot of the stub. The leads are disposed in the respective slots to a depth sufficient to maintain an interlock therebetween in spite of compressive forces imposed on the leads by respective contacts that are adapted to open and close against the leads. These contacts may be contacts suitably supported in a device (i.e., a flashlight) in which the reflector lamp is used. These contacts may be operated from an appropriate switch. Furthermore, in accordance with the invention, the leads are disposed in the respective slots without the requirement of glue or adhesive between the respective leads and slots.

With more particularity regarding the invention, each lead has, in cross-section, a long dimension(d) and a short dimension(w) with the long dimension extending radially of the stub and the short dimension comparable to the slot width. The long dimension, in one embodiment, is at least twice the short dimension. In one particular embodiment described herein, the long dimension may be on the order of 0.041" and the short dimension on the order of 0.015". The leads are preferably embedded in the slot to a depth of at least fifty percent of the lead depth and preferably in a range on the order of fifty to seventy-five percent of the lead depth. In forming said rectangular cross-section, each lead is workhardened along the rectangular cross-section segment thereof. This rectangular cross-section segment of each lead is at least as long as the accommodating slot. The reflector member stub extends from the base neck portion and is of smaller outer diameter (if cylindrical) than the base neck portion. The base neck portion has a cavity for receiving the lamp capsule and a retainer is preferably used for holding the lamp capsule in this cavity. The base neck portion has an end wall integral with the stub and ech stub slot extends through this end wall to enable each lead to be coupled therethrough. Each slot preferably has at the end wall a chamfer or taper for ease of lead insertion.

In accordance with another aspect of the invention, there is provided an improved method of fabricating a reflector lamp which comprises the steps of providing a reflector member having a reflecting portion and a base neck portion with an end-extending stub for the support thereat of metallic lead wires that extend from a low wattage lamp capsule that is disposed in the reflector's member base neck portion. Oppositely disposed elongated slots of rectangular cross-section are provided in the stub and extend to the base neck portion. The lamp capsule leads are flattened to provide along at least a segment of each lead a substantially rectangular cross-section. The flattening step also causes a workhardening of the metallic leads along this segment thus making the leads resistant to bending. The leads are then disposed in the respective slots with a close tolerance fit therebetween to maintain an interlocking therebetween in spite of compressive forces imposed on the leads by respective contacts opening and closing against the leads. Furthermore, this close tolerance fit is carried out without the requirement of adhesive (glue) between the respective leads and slots.

BEST MODE FOR CARRYING OUT THE INVENTION

For a better understanding of the present invention together with other and further objects, advantages, and capabilities thereof, reference is made to the following disclosure and appended claims in connection with the above-described drawings.

The present invention relates to an improved construction for a low wattage reflector lamp and although not specifically limited thereto, the principles of the present invention are in particular adapted for use with low wattage lamps in the range of 2–30 watts. Such reflector lamps may be employed, for example, in flashlights or similar devices.

Reference has been made hereinbefore to the existing use of round lead wires in such low wattage reflector lamps, as well as the problems attendant thereto. In this connection, reference is made to FIGS. 1–3 of the present application for an illustration of the prior art construction that includes a reflector member 10 having a reflector portion 12 and a base neck portion 16 that has integral therewith and extending therefrom a stub portion 18. The entire reflector member 10, as indicated in section, may be constructed of a plastic material having the appopriate reflective coating (not shown) on the concave internal surfaces of the reflecting portion 12 thereof.

Figure 1:
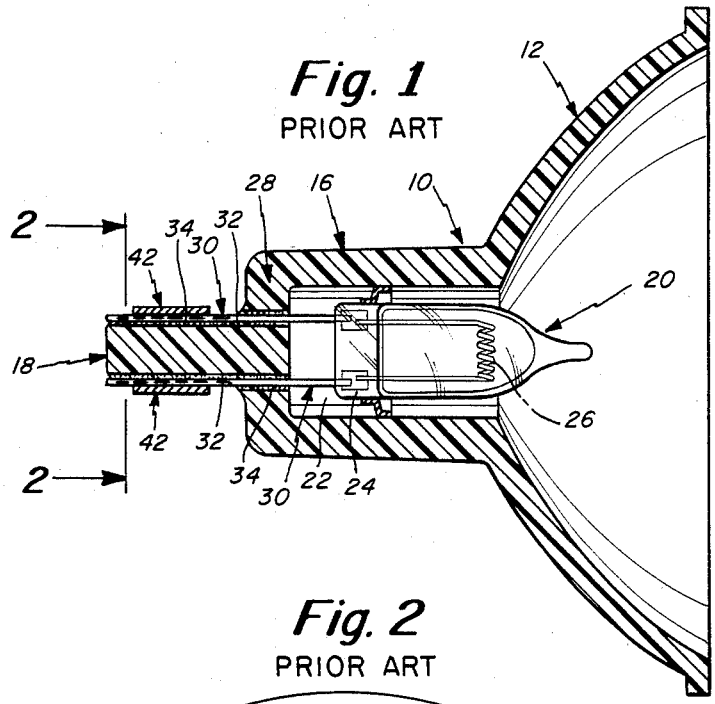
Fig. 1 PRIOR ART
FIG. 1 is a cross-sectional view of a prior art reflector lamp for use in a device (i.e., flashlight) employing both round lead wires and slots, as well as lead-securing glue.

The base neck 16 receives a lamp capsule 20 in its cavity (or central opening) 22 as depicted in FIG. 1. The lamp capsule 20 may be a tungsten halogen lamp capsule having a press seal 24 and supporting a filament illustrated in FIG. 1 at 26. FIG. 1 also illustrates the lead wires 30 that extend from the lamp capsule 20. The metallic lead wires 30 are round and extend through respective round slots 32 that are disposed in the otuer surface of the stub 18, as well as extending through the end wall 28 of the base neck.

Figure 2:
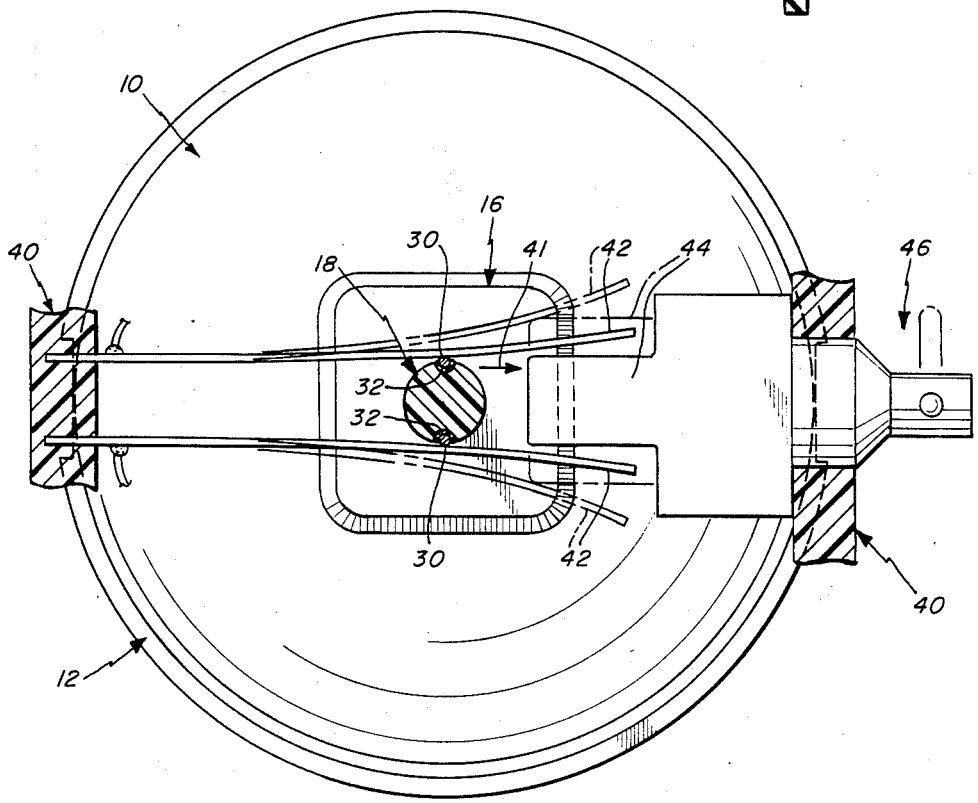
Fig. 2 PRIOR ART
FIG. 2 is a cross-sectional view taken along line 2—2 of FIG. 1, further illustrating the operation of the device's contacts relative to a switch within the device and adapted to open and close the contacts against the leads.
Figure 3:
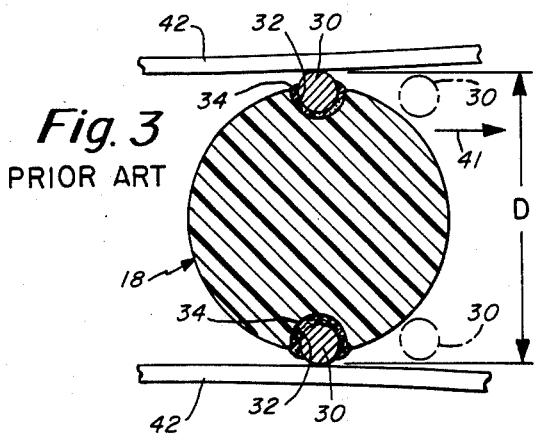
Fig. 3 PRIOR ART
FIG. 3 is an enlarged cross-sectional view of the prior art reflector lamp of FIGS. 1 and 2 illustrating the gluing of the lead wires and furthermore illustrating in phantom the dislodgement thereof.

FIG. 1 illustrates the round metallic lead wires 30 extending in the slots 32 through the end wall 28 as well as along the portion of these slots that extend on the outer surface of stub 18. FIGS. 2 and 3 are cross-sectional views illustrating more clearly slots 32 and stub 18. The enlarged view of FIG. 3 also illustrates in detail the placement of adhesive (or glue) 34 between the respective lead wires and slots. Such Adhesive is deemed necessary in prior embodiments such as illustrated in FIGS. 1–3 to maintain the lead wires in position within their respective slots to prevent them from being dislodged therefrom. In this connection, FIG. 3 also illustrates the lead wires 30 (in phantom) as having been dislodged from their previously accommodating slot.

FIG. 2 illustrates a segment of the device (flashlight) in which the reflector lamp is employed. This includes a housing 40 that supports a pair of contacts 42 which are illustrated in FIG. 2 in solid position as contacting the leads 30, and, alternatively in phantom position as being displaced away from the lead wires 30. In this connection, the operation of contacts 42 occurs from the cam 44 which is also shown in dotted and solid position. In the solid position, cam 44 is out of contact with contacts 42. When the device's switch (46) is moved to an alternate position, then cam 44 as shown in dotted outline is urged against the contacts 42 to spread them and thus displace them away from the lead wires 30. In the solid position of the contacts in FIG. 2, the reflector lamp is activated ("on") whereas the lamp is in its "off" position when the contacts are separated as illustrated in phantom outline in FIG. 2.

In FIG. 2, it should be furthermore noted that contacts 42 are supported so that they impose a force that is generally in the direction of arrow 41 in FIG. 2. In this connection, also note the arrow 41 in FIG. 3. The force is in this direction by virtue of the fact that the contacts 42 are maintained closer together at their fixed end than at their free end. As these contacts are opened and closed, they tend to impose a force in the direction of arrow 41 upon the lead wires 30. Such a compressive force, which occurs during opening and closing, is often sufficient to cause lead displacement. Alternatively, in some mounting arrangements for the reflector lamp, the lamp is required to be rotatably positioned when it is initially inserted into the device. This rotatable positioning is typically through an angle of about ninety degrees such as is illustrated hereinafter in FIGS. 7 and 8. This initial rotational positioning can also cause displacement of the lead wires due to the harsh frictional engagement between the lead wires and the biasing contacts.

Even though the lead wires as illustrated in FIGS. 1–3 are glued in position, extended use of the device over a period of time (in which many openings and closings occur) may cause lead wire dislodgement. Moreover, due to the relatively small size of the parts involved, the glue may not effectively adhere at all positions along each of the lead wires.

In summary, in the prior art construction of FIGS. 1–3, with the use of the round lead wires and round accommodating slots or grooves, and in spite of the use of a securing adhesive or glue, the lead wires may become dislodged providing serious contact problems within the device. This dislodgement may come about by initial insertion of the reflector lamp, particularly when it is rotatably positioned during insertion, or dislodgement may come about by virtue of the compressive forces imposed upon the lead wires upon opening and closing the contacts against the lead wires. Furthermore, in the prior art arrangement as illustrated herein, glue is required in an effort to maintain the lead wires in position. However, the use of the glue carries with it substantial disadvantages such as possible toxicity problems, the extra step in applying the glue, the necessity of removing the glue from the outer surface of the lead wires, the extra time consumed in carrying out this gluing step, and the inconsistency of spacing of the lead wires. With respect to the last problem mentioned, reference is made in FIG. 3 to the dimension D. It is desired that this dimension be set at a relatively precise distance (i.e., such as 0.195"). Because of the required use of glue, it is extremely difficult to control the thickness of the glue layer and thus extremely difficult to control dimension D. This inconsistency in dimensions can, understandably, cause device contact problems.

Reference is now made to the present invention as illustrated in FIGS. 4–8. The improvement in accordance with the present invention is characterized by the use of flattened, workhardened lead wires that are disposed within rectangular slots in the stub portion of the reflector member. This arrangement uniquely provides enhanced placement of the leads within the slots in comparison to the prior version illustrated in FIGS. 1–3. Furthermore, the lead wire and slot construction in accordance with the invention eliminates the required use of a glue or adhesive to secure the leads, thus eliminating the problems and disadvantages associated therewith as has been outlined above.

The flattening of the leads makes them resistant to bending by virtue of the workhardening thereof as caused by this flattening process. In one example (mentioned further below), the rectangular (in cross section) portions of the leads were formed from cylindrical wire having a diameter of 0.028 inch, the resulting rectangular shape having a width of 0.015 inch and a length (or depth) or 0.041 inch. Substantial alteration in cross-sectional shape thus occurs in the original wire to provide the workhardening thereof. Thus, once the leads are inserted into the reflector's slots, additional gluing is not necessary because the flattened leads, being oriented with their longer (depth) dimension projecting radially away resist movement that previously would have caused dislodgement. In addition, the improved construction changes the device contact-to-lead contact location from a "point" contact (round lead against flat contact) to a "line" contact (flat surface against corresponding, flat contact), thus increasing such a location in area and thereby improving the electrical connection thereat. This also improves the conductivity and life of the metal parts.

Figure 4:
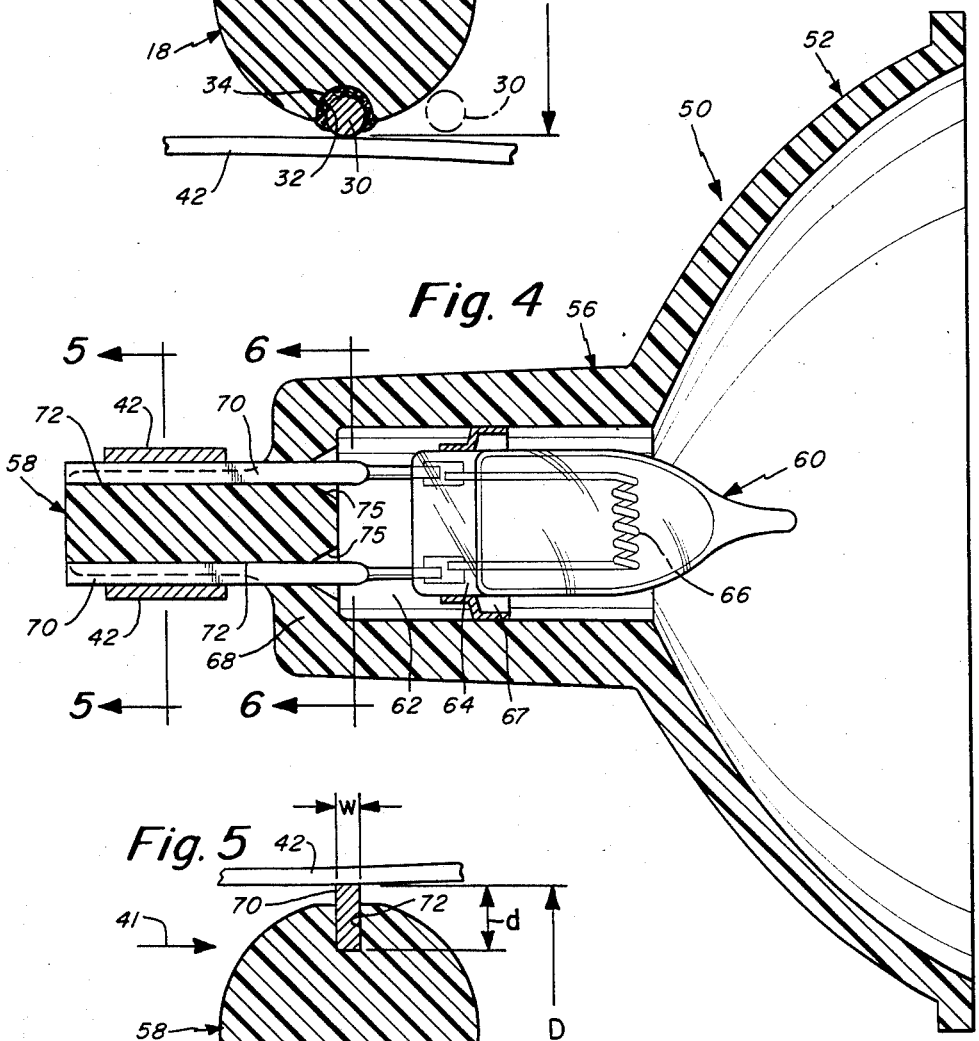
FIG. 4 is a cross-sectional view of a reflector lamp in accordance with the principles of the present invention employing flattened leads and associated, accommodating slots.
Figure 5:
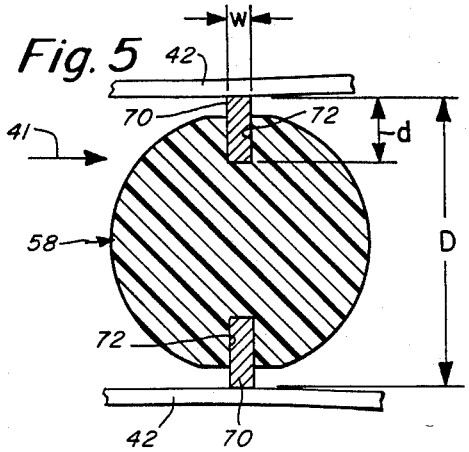
FIG. 5 is a cross-sectional view taken along line 5—5 of FIG. 4 illustrating the flattened leads and accommodating slots along with the device's contacts positioned against the leads.
Figure 6:
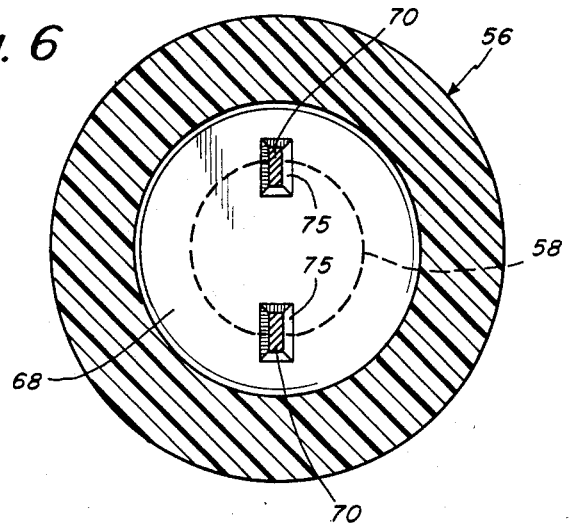
FIG. 6 is a cross-sectional view taken along line 6—6 of FIG. 4.

As shown particularly in FIGS. 4–6, reflector lamp 50 is comprised of a concave reflecting portion 52 and a base neck portion 56 that has extending from the end thereof a tip or stub 58. Disposed within a cavity 62 in base neck 56 is a lamp capsule 60 that is preferably a tungsten halogen lamp capsule. The lamp capsule 60 has a press seal 64 and also supports a filament (illustrated at 66) in FIG. 4. FIG. 4 also shows use of a metallic cup retainer 67 that is desired to hold the lamp capsule 60 in position within cavity 62.

The base neck 56 of the reflector has an end wall 68 through which extend the lead wires 70. The lead wires 70 are of known metallic material (i.e., nickel or nickel-plated steel) and extend from the lamp capsule's press seal. Major segments of each lead wire, as illustrated in FIG. 4, are flattened in the manner described above so as to be workhardened and of substantially rectangular cross-section. In this regard, refer particularly to the cross-sectional views of FIGS. 5 and 6. The lead wires 70 are accommodated with a close tolerance (i.e., friction) fit in oppositely disposed rectangular slots 72 that extend through the wall 68 and along the outer surface of stub 58. In this regard, also refer particularly to FIG. 5. It is noted in these views that no glue is shown as being used. As understood, it is not necessary in the invention to maintain the lead workhardened, rectangular wires in their final position. That is, the flattened lead wires, with their rectangular cross-section, have become resistant to bending as a result of the workhardening that occurs during flattening thereof. Furthermore, the lead wires are inserted into these slots with a close tolerance (i.e., friction) fit to also maintain a positive interlock between the lead wires and the supporting reflector member.

Each of the lead wires has a depth dimension illustrated in FIG. 5 by the dimension(d) and also a width dimension as illustrated in FIG. 5 by the dimension (w). It is noted and again worth mentioning that the longer depth dimension(d) extends radially of the stub. The shorter, width dimension(w) is comparable to the width of the respective slot. It is preferred that dimension(d) be at least twice dimension(w). In one particular embodiment, as stated above, the dimension(d) was 0.041 inch and the dimension(w) 0.015 inch. Significantly, leads 70 are embedded in the accommodating slot to a depth of at least fifty percent of the total lead depth(d). More preferably, the leads are embedded in the respective slots to a depth in the range of fifty to seventy-five percent of lead depth. In the embodiment in which the long dimension is 0.041 inch, the depth of the slot is preferably 0.030 inch, leaving a totally exposed lead depth of 0.011 inch.

In accordance with the method of fabrication of the reflector lamp of the present invention, a lamp capsule with round lead wires is altered by flattening at least part of the lead wires to a substantially rectangular cross-section. In one example (i.e., as shown in FIG. 4), substantially only the part of the lead wires which are positioned within the respective slots were flattened. The remaining segments (those secured within and projecting from the capsule's press seal) maintained their original cylindrical (i.e., 0.028 inch diameter) dimensions. The lamp capsule may then be engaged with a retainer and this assembly then inserted into the cavity 62 in the base neck 56 of the reflector member. The slots that accommodate the lead wires are provided with a chamfer (taper) at 75 for ease of insertion of the lead wires. As the lead wires 70 are inserted, they are also forced to be firmly seated in the slots. These workhardened lead wires are resistant to bending or outward deflection to thus assure positive seating thereof despite extended periods of contact by the respective electrical contacts within the device.

A comparison of FIGS. 3 and 5 also illustrate the type of contact that occurs both with the prior art version and the version of the present invention. It is noted in FIG. 3 that there is essentially a "point" contact between the round lead wires and associated flat contacts 42. However, in FIG. 5 it is noted that there is a much larger in area (or "line") contact (dimension(w)) between the lead wires and their associated contacts 42.

In fabricating the rectangular cross-section lead wires, it is noted that, as mentioned previously, in one embodiment the dimensions are 0.015 inch for the width and 0.041 inch for the depth. The depth dimension(d) is greater than the diameter of the initial lead by about sixty-eight percent. The initial, cylindrical lead has a diameter of 0.028 inch. Because the undesired bending is in the direction of arrow 41 in FIG. 5, this change in dimension increases the bending resistance. Furthermore, as illustrated previously, the workhardening that occurs on the lead wire also increases the bending resistance.

Figure 7:
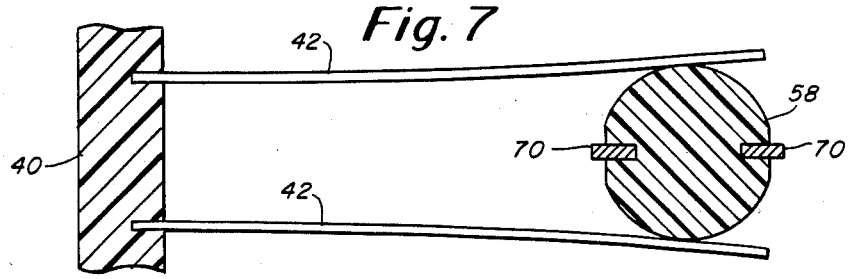
FIGS. 7 and 8 are respective views illustrating the reflector member in a first position in FIG. 7 and rotatably positioned to a second position in FIG. 8 where it is interlocked in the device in which the reflector lamp is used.
Figure 8:
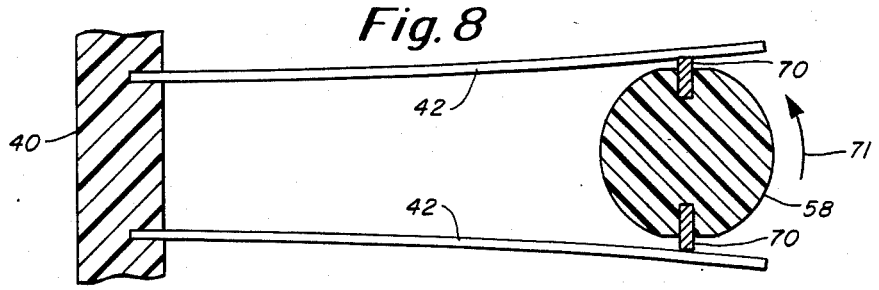

FIG. 7 illustrates the reflector stub 58 of the invention in an initial position during insertion thereof into the device into which it is to be used. In some devices, such as for flashlight applications, it is required that the reflector lamp be interlocked by being inserted and then rotated through, say ninety degrees. Thus, FIG. 7 shows this initial position and FIG. 8 shows the final position that the invention is rotated to and in which the invention is locked. Note the arrow 71 in FIG. 8 illustrating this direction of rotation. With the firm interlocking of the lead wires as in accordance with the present invention, neither the initial rotation as illustrated in FIGS. 7 and 8, nor the continued compression by the contacts 42 will cause any dislodgement of the invention's lead wires 70.

While there have been shown and described what are at present considered the preferred embodiments of the invention, it will be obvious to those skilled in the art that various changes and modifications may be made therein without departing from the scope of the invention as defined by the appended claims:

We claim:

1. A reflector lamp for being positioned within a device having contacts therein, said reflector lamp comprising:

a reflector member having a reflecting portion and a base neck portion with a stub portion extending therefrom, said stub portion having elongated slots of rectangular cross-section disposed along the exterior of at least a portion of said stub;

a lamp capsule disposed within said base neck portion and having a pair of lead wires extending therefrom for being positioned within said slots of said stub portion;

said pair of lead wires each having, along at least a segment thereof, a rectangular cross-section of dimension sufficient to provide a snug fit within a respective one of said slots within said stub portion;

said lead wires being disposed within said respective slots to a depth sufficient to maintain an interlock therebetween despite exertion of compressive forces imposed on said leads by said contacts within said device which open and close against said lead wires, said lead wires being so disposed within said slots without the requirement of adhesive between said lead wires and slots.

2. The reflector lamp as set forth in claim 1 wherein each lead wire, in cross-section, includes a depth dimension and a width dimension, said depth dimension extending radially of said stub portion and said width dimension comparable to the respective width of said slot.

3. The reflector lamp as set forth in claim 2 wherein said depth dimension is at least twice said width dimension.

4. The reflector lamp as set forth in claim 3 wherein said depth dimension is about 0.041 inch and said width dimension is about 0.015 inch.

5. The reflector lamp as set forth in claim 3 wherein each of said lead wires is embedded within said slot to a depth in a range fifty percent to seventy-five percent of the total depth of said lead wire.

6. The reflector lamp as set forth in claim 3 wherein each of said lead wires is embedded within said slot to a depth of at least fifty percent of the total depth of said lead wire.

7. The reflector lamp as set forth in claim 1 wherein each lead wire is workhardened along the rectangular cross-section segment thereof.

8. The reflector lamp as set forth in claim 1 wherein said rectangular cross-section segment of each lead wire is at least as deep as said slot having said lead wire therein.

9. The reflector lamp as set forth in claim 1 wherein said reflector member may be rotatably positioned relative to said contacts within said device.

10. The reflector lamp as set forth in claim 1 wherein said stub portion of said reflector member extending from said base neck portion is of a smaller outer diameter than said base neck portion.

11. The reflector lamp as set forth in claim 10 wherein said base neck portion has a cavity for receiving said lamp capsule.

12. The reflector lamp as set forth in claim 11 further including a retainer member located within said cavity for holding said lamp capsule within said cavity.

13. The reflector lamp as set forth in claim 12 wherein said base neck portion has an end wall integral with said stub portion.

14. The reflector lamp as set forth in claim 13 wherein each of said slots extends through said end wall to enable each of said lead wires to be coupled therethrough.

15. The reflector lamp as set forth in claim 14 wherein each of said slots includes a chamfer at said end wall to facilitate insertion of said lead wire within said slot.

16. The reflector lamp as set forth in claim 1 wherein said reflector member is constructed of plastic and said lamp capsule comprises a low wattage tungsten halogen capsule having a press seal, said lead wires being of metallic material and extending from said press seal.

17. A method of fabricating a reflector lamp for being positioned within a device, said method comprising the steps of providing a reflector member having a reflecting portion and base neck portion with a stub portion extending therefrom for the support thereat of metallic lead wires that extend from a low wattage lamp capsule meant to be disposed within said base neck portion, providing oppositely disposed elongated slots of rectangular cross-section within said stub portion and extending to said base neck portion, flattening said lamp capsule lead wires to provide along at least a segment of each of said lead wires a substantially rectangular cross-section, said flattening step also causing a workhardening of said metallic lead wires along said segment, and disposing said lamp capsule in said base neck portion with said lead wires in said respective slots and forming a close tolerance fit therebetween to maintain an interlocking therebetween despite exertion of compressive forces on said lead wires by respective contacts within said device opening and closing against said lead wires, said lead wires positioned within said slots without the requirement of adhesive between the respective lead wires and slots.

18. The method as set forth in claim 17 wherein said flattening includes providing each of said lead wires with, in cross-section, a depth dimension and a width dimension with said depth dimension extending radially of said stub portion and said width dimension comparable to said width of said slot.

19. The method as set forth in claim 17 wherein each of said lead wires is embedded within said respective slot to a depth to at least fifty percent of said depth of said lead wire.

20. The method as set forth in claim 17 wherein said rectangular cross-section segment of each lead wire is at least as deep as said slot having said lead wire therein.

21. The method as set forth in claim 17 wherein said reflector member is rotatably positioned relative to said contacts when positioned within said device.

22. The method as set forth in claim 17 further including providing said base neck portion with an end wall integral with said stub portion, each of said slots extending through said end wall to enable each of said lead wires to be coupled therethrough, said method further including providing a chamfer within each slot at said end wall for ease of lead wire insertion.

* * * * *